US005503400A

United States Patent [19]

Silva

[11] Patent Number: 5,503,400

[45] Date of Patent: Apr. 2, 1996

[54] CHESS SET CONSTRUCTION

[76] Inventor: Anselmo Silva, 1309 43rd St., North Bergen, N.J. 07047

[21] Appl. No.: 465,930

[22] Filed: Jun. 6, 1995

[51] Int. Cl.[6] ..... A63F 3/02

[52] U.S. Cl. ..... 273/260; 273/239; 273/241; 273/282.1; 273/288

[58] Field of Search ..... 273/260, 261, 273/239, 241, 282.1, 288

[56] References Cited

U.S. PATENT DOCUMENTS

| | | | |
|---|---|---|---|
| 413,026 | 10/1889 | Catlin | 273/282.1 |
| 3,880,429 | 4/1975 | Blumenaus | 273/282.2 |
| 4,055,345 | 10/1977 | Havlik | 273/282.1 |
| 5,040,800 | 8/1991 | Ulan | 273/260 X |
| 5,338,041 | 8/1994 | Jones et al. | 273/260 |

*Primary Examiner*—William E. Stoll
*Attorney, Agent, or Firm*—Stoll, Miskin, Previto & Hoffman

[57] ABSTRACT

A chess set construction permitting chess to be played with the chess board in a vertical position, removably mounted in a frame on a wall, and in a horizontal position, as on a table. Each chess piece is bisected, being rejoinable by a tongue and groove. At least one of the halves of each chess-piece has a magnet, and the chess board is a magnetic receptor, such that each such magnet half piece may be held in playing position on the chess board when the chess board is vertical on a wall, with each half piece being viewed in normal upright profile. Display storage provisions are made for the halves of each playing piece not in play. The chess board is removable from the wall frame with the half-pieces remaining in position for continuation of play on a horizontal table. The mating halves of each piece may be assembled to each other for normal upright play on the horizontal chess board; while they are fully stored-displayed on upper and lower parts of the frame, so that there is always a permanent full display of the Total Chess Set.

18 Claims, 4 Drawing Sheets

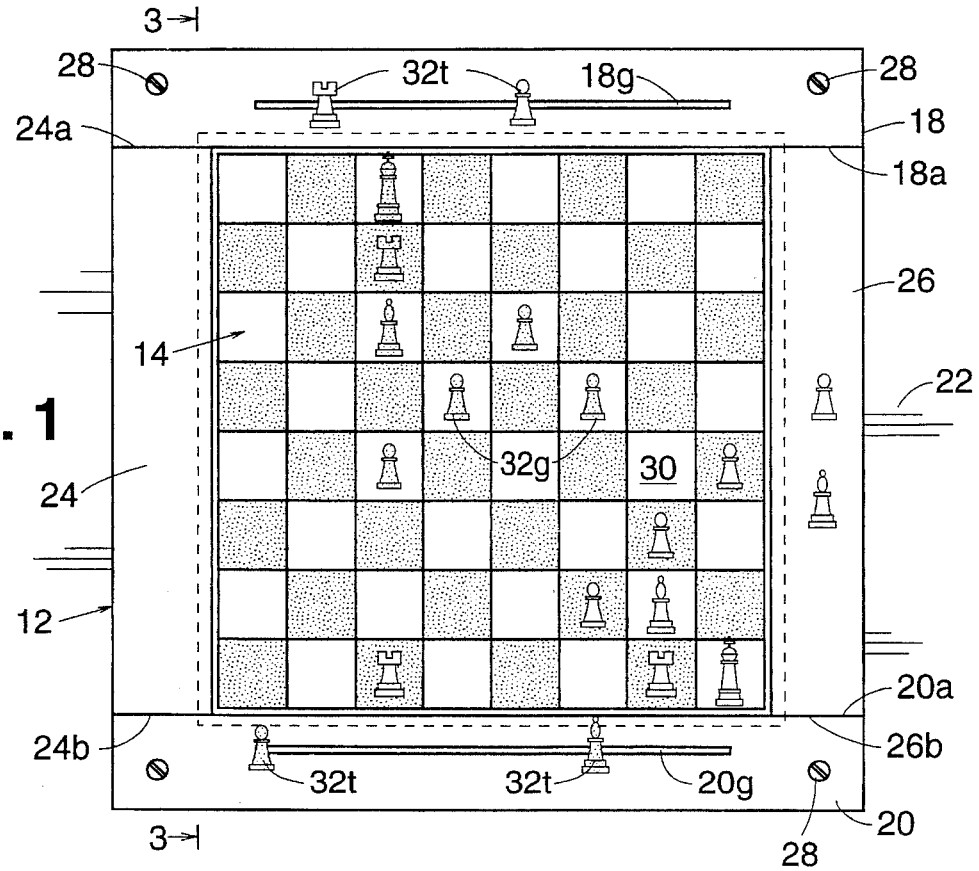
FIG. 1
FIG. 2
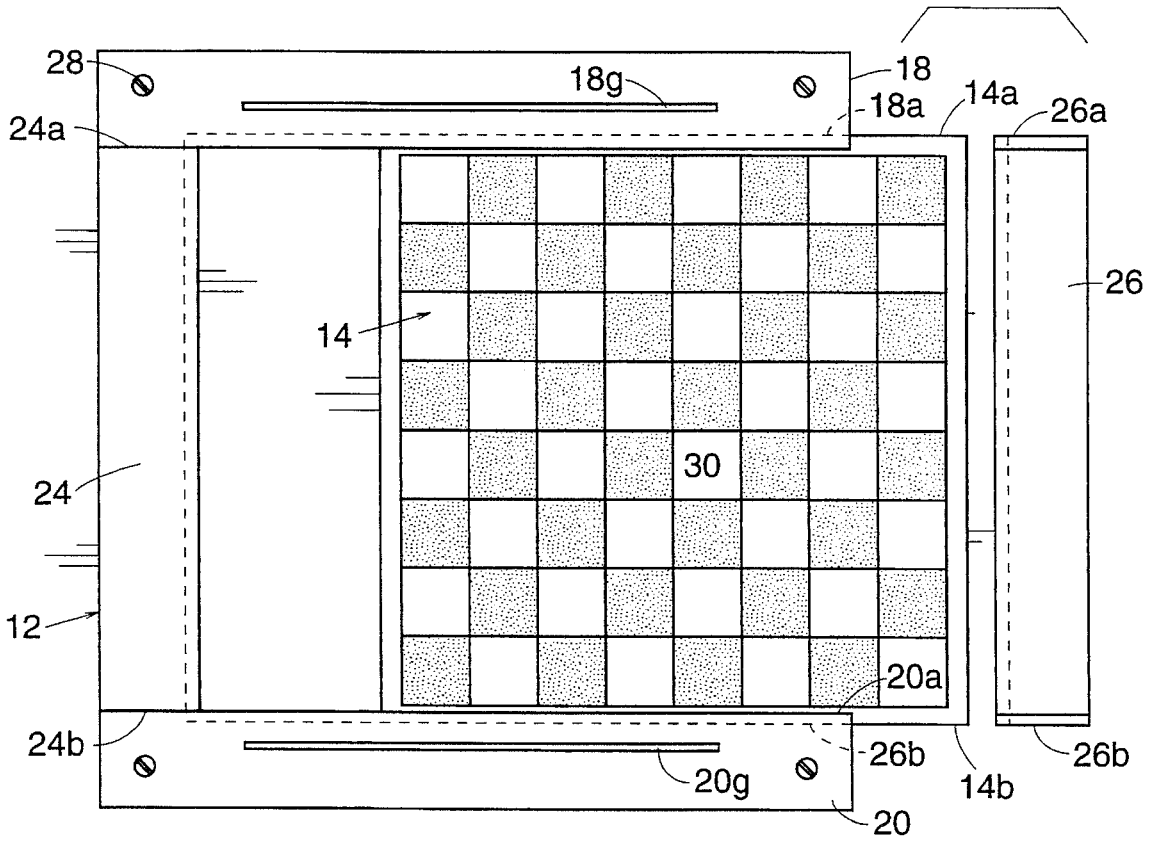

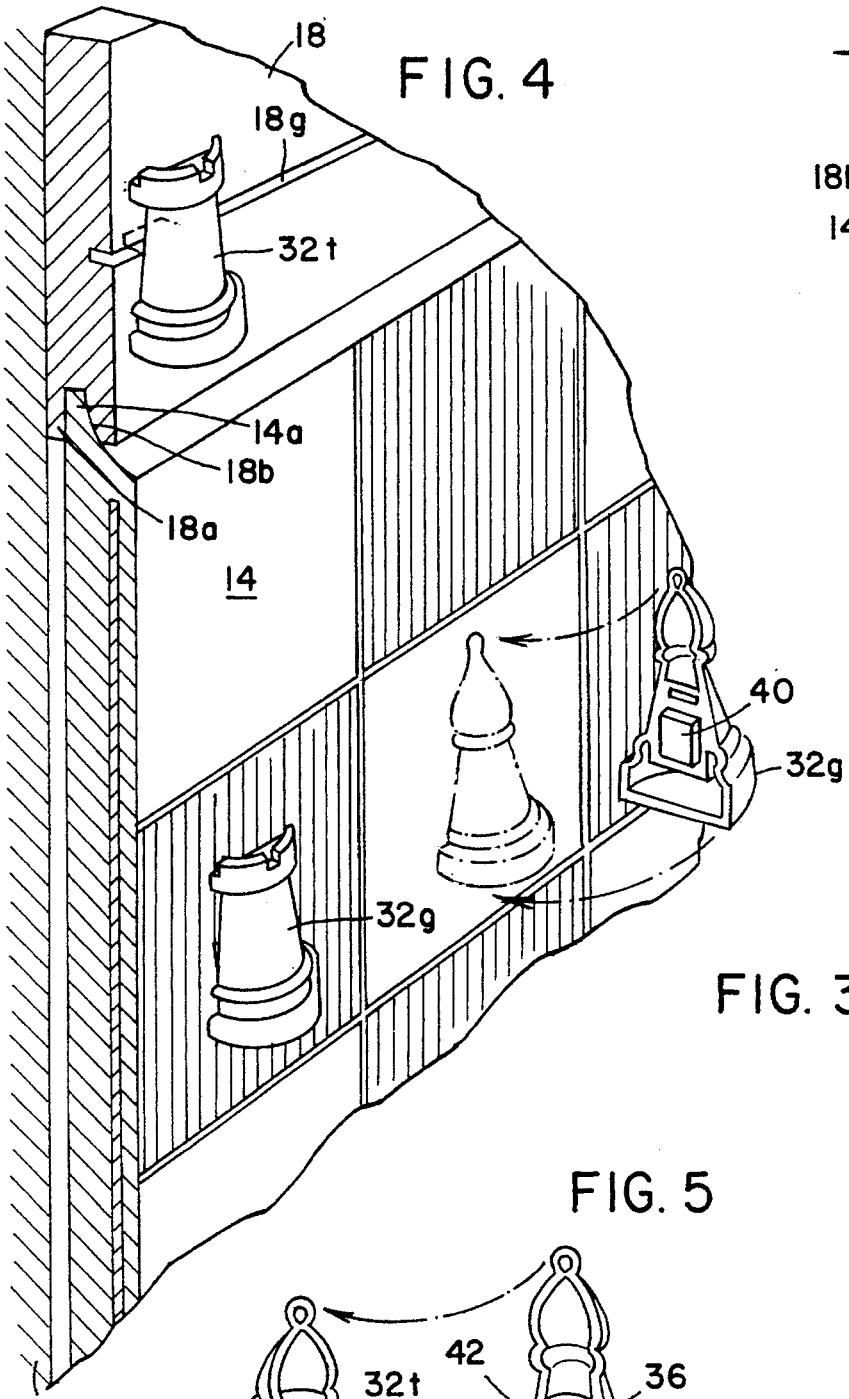
FIG. 4
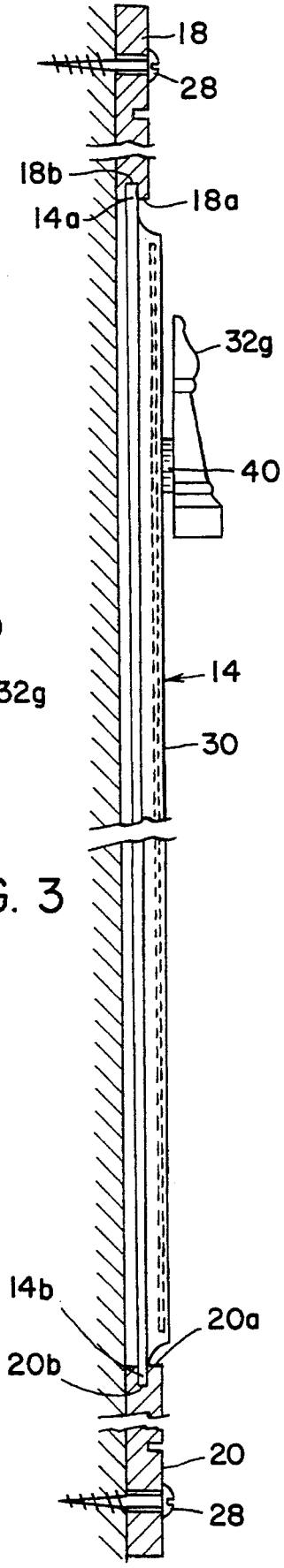
FIG. 3
FIG. 5
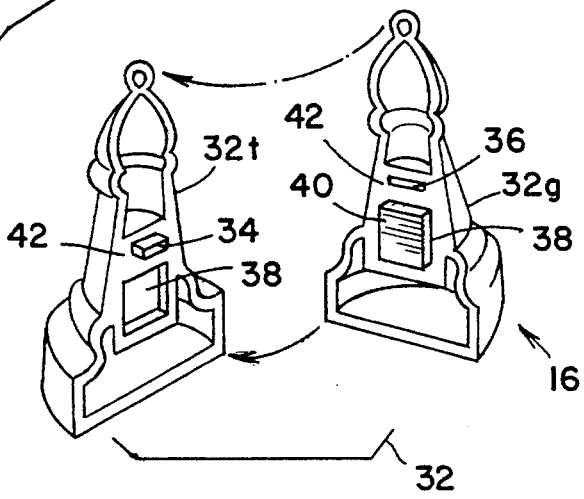

FIG. 9
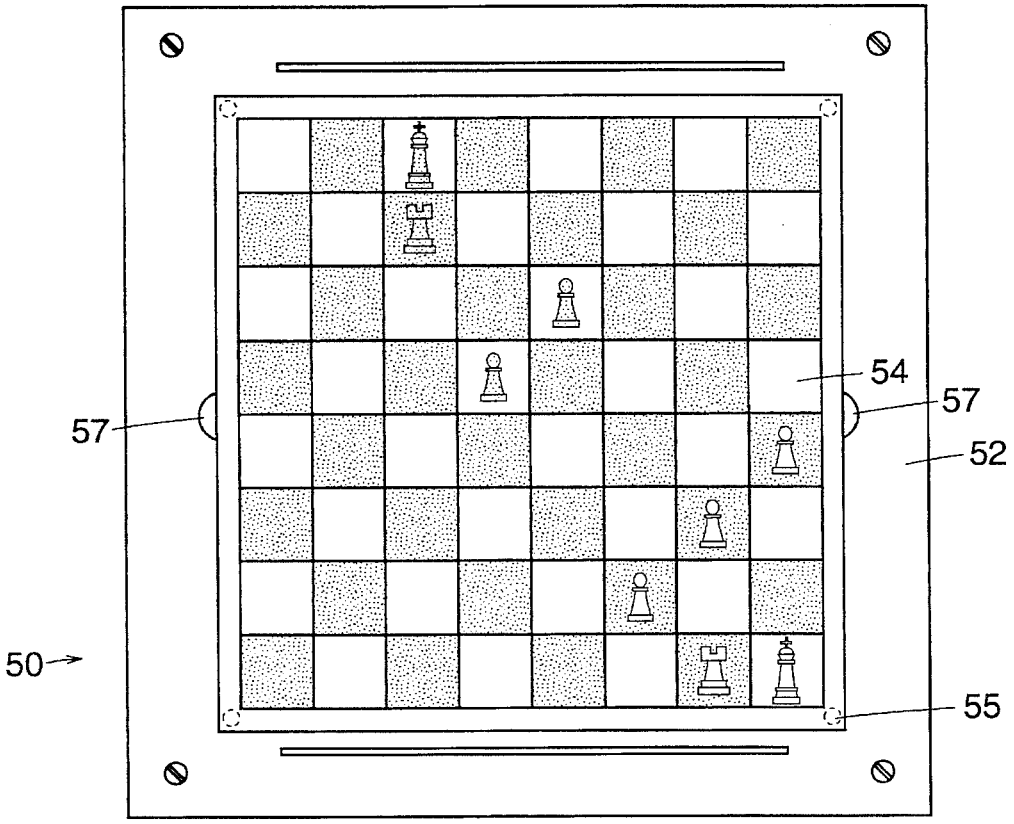
FIG. 10
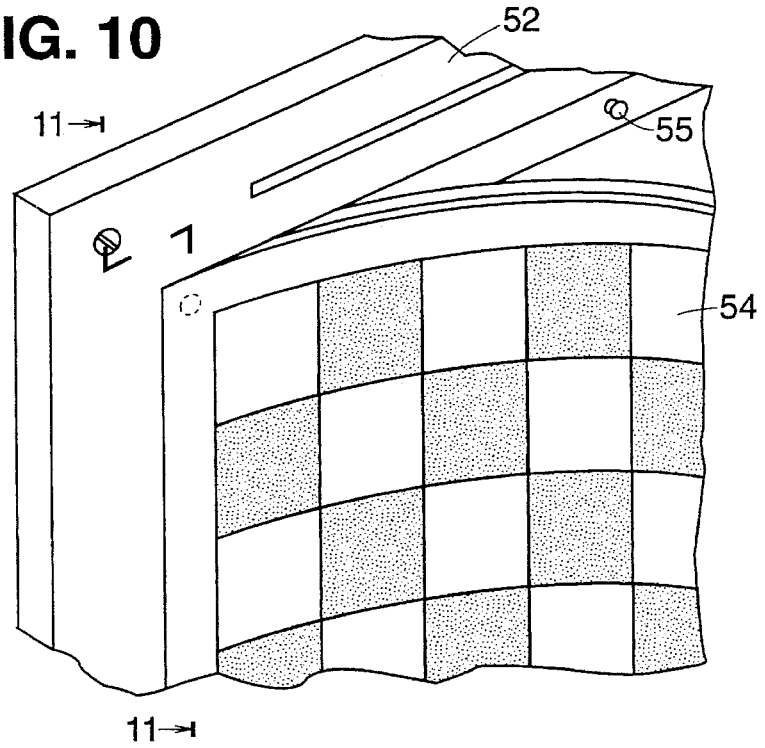
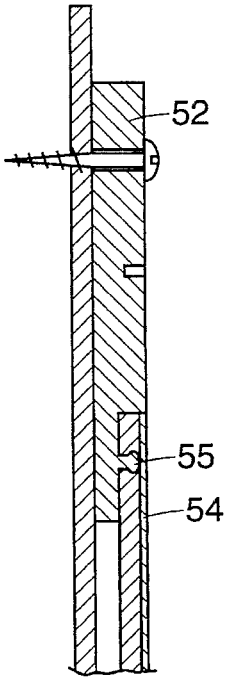
FIG. 11

CHESS SET CONSTRUCTION

REFERENCE TO RELATED DOCUMENT

Reference is made to Disclosure Document Number 372718, filed Mar. 21, 1995 by the present applicant.

BACKGROUND OF THE INVENTION

Chess is usually played by two persons in a confined space with the following limitations:

a) Limited corporal (body) movement, typically in a seated position; and limited physical and mental comfort.

b) Limited playing time, because the players can not leave without worry that the chess set will be disturbed during a break in the game.

c) Limited surrounding spectators because it is hard for them to follow the game with comfort; this is worse with computer chess.

d) Limited means to allow visibility of game to others.

e) Limited possibility to display the whole chess set permanently during and after the game; thus limiting the participation and practice by more people, at any time, of this important mankind's resource to develop personal analytical skill at any age.

The present invention was developed to eliminate all these limitations yet provide a simple and not sophisticated device.

SUMMARY OF THE INVENTION

The invention provides convertible means for chess to be played with the players able to make their moves when they please, regardless of the posture; or with the chess board placed on a table since the chess-board may be removed from the wall with the playing pieces in place.

Means are provided to keep the chess-pieces in a conventional vertically upright position regardless of whether the chess board is vertical or horizontal.

For wall use, in the preferred embodiment a frame is provided with at least top and bottom horizontal frame members being fastened to the wall. The chess board slides into the horizontal frame members and the side frame members are attached. Removal of one vertical frame member permits the board to slide out and be placed horizontally on table. For vertical use on the wall, the chess board and chess pieces are magnetized so that the chess piece may be magnetically fixed to the chess board and moved to varying playing positions although the chess board is vertical. For this purpose, each chess piece is divided in half along its normally vertical axis. A tongue and groove are provided to join the two halves together to form a single playing piece of normal configuration. The half having the groove is the half which has the magnet and is used for vertical wall use. In the vertical wall position, the chess piece is also vertical, that is, parallel to the chess board and held in place magnetically. When the chess board and magnetically attached half-pieces are removed from the wall and placed on a horizontal table, the magnetic half of each playing piece is now horizontal and while the game may continue to be played in this position, it may not be preferred by some players. Each magnetic half piece may be joined by the tongue and groove to its non-magnetic other half and turned vertically, that is, perpendicular to the horizontal chess board, for normal upright playing position on the horizontal chess board.

The chess set is always stored-displayed regardless it is being used or not; contrary to the traditional hidden away storage of other chess sets when not in use. The applicant intends to market chess sets embodying the invention under the trademark "Total Chess Set".

DESCRIPTION OF THE DRAWING

In the drawing:

FIG. 1 is a plan view of the chess set construction of the invention shown in a vertical position on a wall.

FIG. 2 is an assembly view of the chess board construction of the invention shown partially removed from the wall frame means.

FIG. 3 is a cross-sectional view taken across line 3—3 of FIG. 1.

FIG. 4 is an enlarged fragmentary view, partly in cross-section, of a portion of the wall-mounted chess board of FIG. 1, showing a magnetic-half piece being placed in position on the chess board.

FIG. 5 is an assembly view of the two halves of a playing piece in accordance with the chess set construction of the invention.

FIG. 9 is a view, similar to that of FIG. 1, of an alternate embodiment of the chess game construction of the invention in which the board is snapped into place in wall-mounted support means.

FIG. 10 is an enlarged fragmentary view of the alternate embodiment shown in FIG. 9, with a portion of the board is unsnapped from the wall-mounted support means. The degree to which the board is shown flexed is exaggerated for clarity.

FIG. 11 is a cross-sectional view taken across line 11—11 of FIG. 10.

DESCRIPTION OF THE PREFERRED EMBODIMENT

Figure 6:
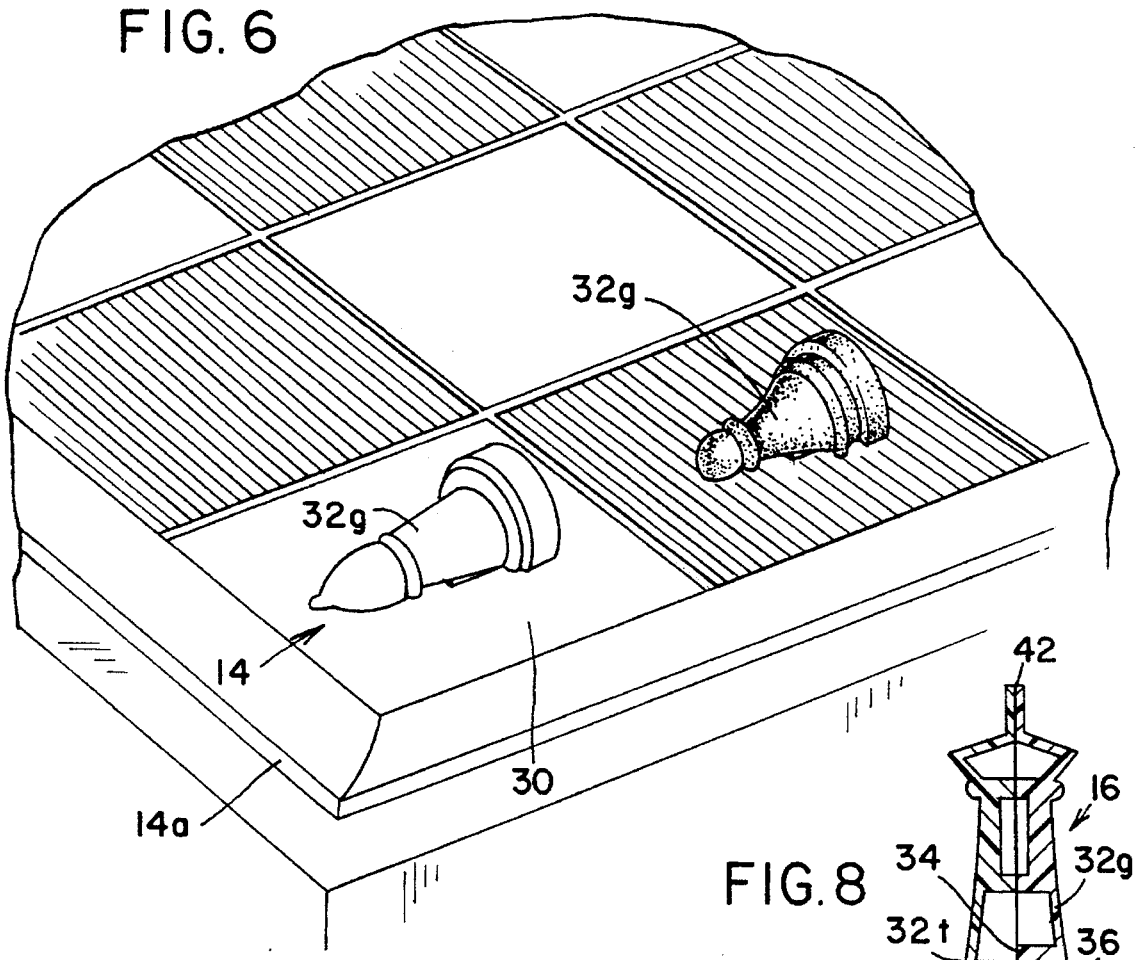
FIG. 6 is an enlarged fragmentary view of a portion of the chess board in accordance with the chess set construction of the invention shown on a horizontal surface, with the playing pieces unmoved relative to the chess board from the wall position of FIG. 1.

With reference to the drawing, the chess set construction 10 of the present invention comprises wall-mount support means 12, chess board means 14 and chess piece means 16.

Wall-mount support means 12 comprises, in the preferred embodiment, a pair of top and bottom wall-mounted frame members 18 and 20, respectively, horizontally fixed to a wall 22 or other substantially vertical support surface. The bottom edge 18*a* of top frame member 18, and the top edge 20*a* of bottom frame member 20 each have a horizontal groove 18*b* and 20*b*, respectively.

Wall-mount support means 12 further comprises a pair of oppositely disposed vertical side frame members 24 and 26, the top edges 24*a* and 26*a* of each, respectively, and the bottom edges 24*b* and 26*b* of each, respectively, are tapered or chamfered to form horizontal tongues adapted to engage and slide in horizontal grooves 18*b* and 20*b*, respectively. When in place, the combination of horizontal wall-mounted frame members 18 and 20 and vertical frame members 24 and 26 form rectilinear wall-mount support means 12.

Chess board means 14 comprises a planar playing surface 30 which is typically square, and has a top edge 14*a* and a bottom edge 14*b* extending beyond playing surface 30 and which are tapered or chamfered to form horizontal tongues adapted to engage and slide in horizontal grooves 18*b* and 20*b*, respectively. Playing surface 30 is a magnetically sensitive or a magnetic receptor, such as sheet steel with an enamelled checkerboard design, such that a magnet will be attracted to the surface.

Top and bottom frame members 18 and 20 are fastened horizontally to vertical wall 22 by conventional means 28 at a spaced distance substantially corresponding to the top to bottom dimension of playing surface 30 of chess board means 14 such that top tongue 14*a* may engage and slide in groove 18*b* and bottom tongue 14*b* may engage and slide in groove 20*b* simultaneously. Thus, chess board means 14 may be vertically slidably or snappably mounted in and slidably or snappably removed from wall-mount support means 12. Side frame members 24 and 26 may likewise be slidably mounted in grooves 18*b* and 20*b* so as to form a four-sided rectilinear or square frame removably holding the chess board. By removal of one or both of side frame members 24 and 26, chess board means 14 may be removed from its vertical wall-mount position and be placed on a horizontal table.

Chess piece means 16 comprises the full conventional set of chess playing pieces 32, each playing piece 32 being cut in half along the vertical axis of each piece or bisected or formed in two parts. One such part 32*t* of each playing piece 32 has a tongue 34 and the other such part 32*g* has a corresponding mating groove 36 such that tongue part 32*t* and groove part 32*g* may be secured together to form the complete playing piece 32 or separated for use as below indicated.

Each groove part 32*g* and tongue part 32*t* is provided with a magnet recess 38 for receiving a magnet 40. Each magnet recess 38 is open on the plane of the cut or inner surface 42 of each playing piece part 32*g* and 32*t*. Magnet 40 is secured in recess 38 of each groove part 32*g* such that when each groove part 32*g* is placed on or immediately adjacent playing surface 30, magnet 40 magnetically attaches groove part 32*g* thereto.

For proper playing position, groove part 32*g* of each playing piece 32 is placed with inner surface 42 adjacent and parallel to playing surface 30. In such position, the full shape and contour of each groove part 32*g* of a playing piece 32 is readily visible, apparent and recognizable, as may be seen in FIGS. 1, 4 and 6.

An attached groove part 32*g* may be removed from playing surface 30, either for moving or repositioning to another playing position or for removal from the game, by manually pulling such groove part 32*g* off playing surface 30. In order to make an attached groove part 32*g* easy to grip and pull off playing surface 30, magnet 40 extends beyond the plane of inner surface 42 of groove part 32*g*, and in effect sticks out of the back of groove part 32*g*. Accordingly, as may be seen in FIG. 3, when groove part 32*g* is placed on playing surface 30, it is magnet 40 which is in contact with playing surface 30 and groove part 32*g* is spaced a small distance from playing surface 30 sufficient to allow a better grip by the player's fingers.

Recess 38 on tongue part 32*t* is positioned similarly to that of recess 38 on groove part 32*g*. When the two mating parts 32*t* and 32*g* of a playing piece 32 are joined together, the portion of magnet 40 which extends beyond the plane of inner surface 42 also extends into recess 38 of tongue part 32*t* as may be seen in FIG. 8.

When chess board means 14 is vertically wall-mounted only groove parts 32*g* are used in play as they are magnetically attachable to playing surface 30 and stand vertically upright, as shown in FIGS. 1 and 4, the conventional playing position. Those of groove parts 32*g* which are not in play may be magnetically secured for storage and display to any of top frame member 18, bottom frame member 20 or side frame members 24 and 26 which are magnetically sensitive or magnetic receptors. Those of groove parts 32*g* which are not in play may be aligned in a pleasing visual presentation on the frame members as the chess board means, in its vertical wall-mounted position, is on display.

Figure 7:
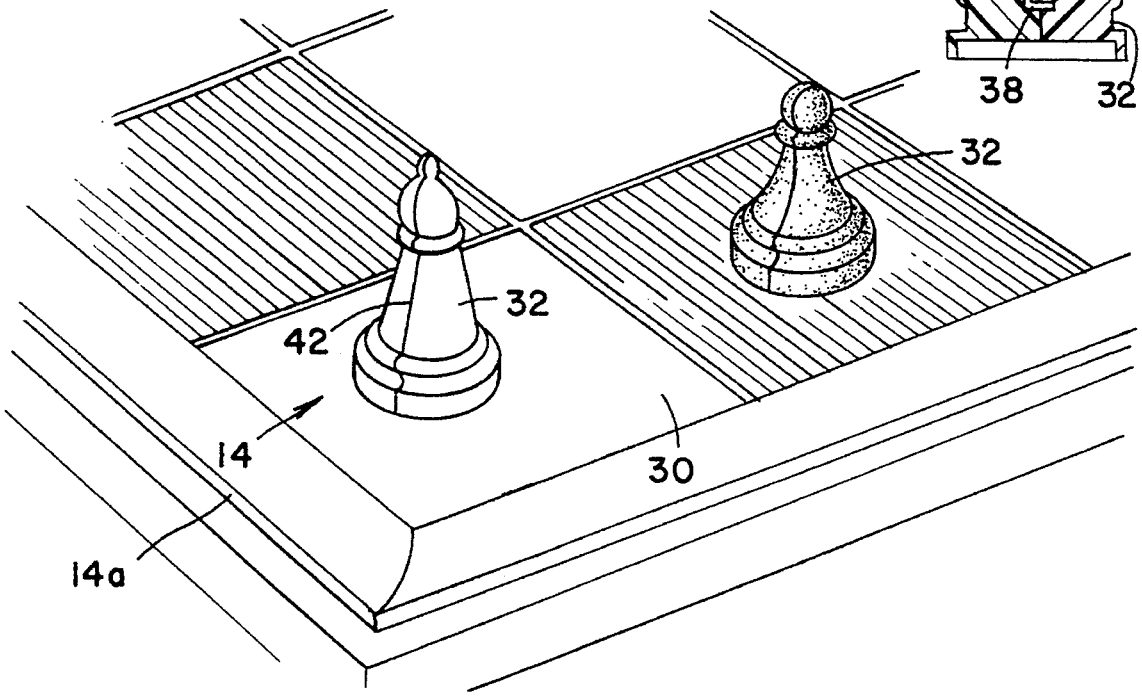
FIG. 7 is a view similar to that of FIG. 6, with the playing pieces assembled and placed vertically on the horizontal chess board.

Tongue parts 32*t* are stored-displayed with tongue 34 in horizontal grooves 18*g* and/or 20*g* provided in the front of top frame member 18 and bottom frame member 20, respectively. Tongue 34 of each tongue parts 32*t* is spaced at the same distance from the bottom of the chess piece means 16 such that, when several tongue parts 32*t* are stored in horizontal grooves 18*g* and/or 20*g*, the bottom of each of the pieces are in horizontal alignment for each of such horizontal grooves, providing pleasing visual display. As tongue parts 32*t* in the preferred embodiment are not magnetized or provided with a magnet, they are not used in play alone. They are used in play only when in assembled association with mating groove parts 32*g* to form complete playing pieces 32 as shown in FIG. 7.

When vertically wall-mounted chess board means 14 is removed from wall-mounted support means 12 and placed horizontally on a table while a game is underway, those of groove parts 32*g* which were in playing positions while playing surface 30 was vertical remain in the same positions on the playing surface 30 so that the game can continue with playing surface 30 horizontal. Each groove part 32*g*, while retaining its playing position relative to playing surface 30, has now moved from a conventional vertically upright position as shown in FIGS. 1, 3 and 4 to a horizontal position as shown in FIG. 6. While play in that position is eminently possible, and indeed convenient if the chess board is jostled or is to be returned to the vertical wall mount position while the game continues, for players who prefer conventional upright full playing pieces, each groove part 32*g* may be joined to its mating tongue part 32*t* and placed vertically upright on the horizontal board as shown in FIG. 7.

Figure 8:
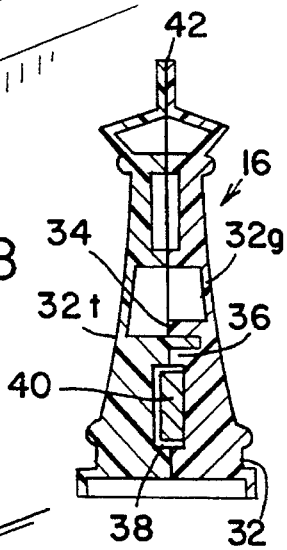
FIG. 8 is an enlarged cross-sectional view across both halves of an assembled chess piece.

It should be noted that the shape of the tongues and grooves is not a significant part of the invention and may be altered to suit. It is further noted that when the tongue part 32*t* and groove part 32*g* are combined to form a chess playing piece 16, that such playing piece contains magnet 40 as shown in FIG. 8. If magnet 40 is strong enough and close enough to the bottom of the chess playing piece, then the playing piece will be magnetically secured to chess board 14 when playing piece 16 is in its upright standing position on a horizontal board, as shown in FIG. 7. Alternatively, a second magnet may be placed closer to or at the base of one of the halves of chess playing piece 16 so that the playing piece is held to the board by magnetic attraction when the board is in a horizontal position and the chess piece is upright, as well as when the board is in the vertical position and the magnet containing half of the playing piece, groove part 32*g*, is on the board.

As the frame is wall-mounted, it may be used for display of advertisements of various kinds, including advertising displays which are magnetized and magnetically attached to the frame.

In an alternate embodiment of chess game construction 50, chess board means 54 may be snapped into wall-mount support means 52, which has fasteners or a flexible rim provided for the purpose.

What is claimed is:

1. Chessboard and chess playing piece means convertible between vertical and horizontal orientations, comprising:

a. chessboard means, said chessboard means comprising a playing surface useable in vertical and horizontal orientations, b. vertical-mount means, said vertical-mount means being adapted to removably attach said chessboard means in a vertical playing position, c. playing means, said playing means comprising chess pieces each being removably attachable to said chessboard means in both vertical and horizontal orientations of said playing surface, d. each said chess piece comprising separable and rejoinable section means.

2. Chessboard and playing piece means in accordance with claim 1, wherein:

a. each said chess piece section means comprises tongue section means including a tongue and groove section means including a groove, said tongue and said groove cooperating to removably join said tongue section means to said groove section means; and b. said groove section means further comprising board attachment means, said board attachment means comprising means to removably attach said groove section means to said playing surface.

3. Chessboard game and playing piece means in accordance with claim 2, wherein:

said board attachment means comprises magnetic means, and said playing surface comprises magnetic attraction means.

4. Chessboard and playing piece means in accordance with claim 2, wherein:

said magnetic means extends beyond the surface of said groove section means which is closest to said playing surface when said groove section means is attached to said playing surface.

5. Chessboard game and playing piece means in accordance with claim 2, wherein:

said vertical-mount means comprises frame means, said frame means being fastenable to a wall, said frame means having attachment means to removably attach said chessboard means to said frame means.

6. Chessboard and playing piece means in accordance with claim 5, wherein:

said attachment means comprises groove means, said chessboard means having tongue means cooperating with said groove means whereby said chessboard means is slidably attachable to and removable from said frame means.

7. Chessboard game and playing piece means in accordance with claim 6, wherein:

at least a portion of the front face of said frame means comprises additional groove means, said additional groove means being adapted to receive said tongue of said chess piece tongue section means.

8. Chessboard and playing piece means in accordance with claim 6, wherein:

at least a portion of the front face of said frame means is magnetically sensitive, said portion being adapted to receive said chess piece groove section means.

9. Chessboard game and playing piece means in accordance with claim 5, wherein:

said attachment means comprises groove means, said chessboard means having tongue means cooperating with said groove means whereby said chessboard means is snappably attachable to and removable from said frame means.

10. Board game and playing piece means convertible between vertical and horizontal orientations, comprising:

a. game board means, said game board means comprising a playing surface useable in vertical and horizontal orientations, b. vertical-mount means, said vertical-mount means being adapted to removably attach said game board means in a vertical playing position, c. playing means, said playing means comprising multiple playing pieces each being removably attachable to said game board means in both vertical and horizontal orientations of said playing surface, d. each said chess piece comprising separable and rejoinable section means.

11. Board and playing piece means in accordance with claim 10, wherein:

a. each said playing piece section means comprises tongue section means including a tongue and groove section means including a groove, said tongue and said groove cooperating to removably join said tongue section means to said groove section means; and b. said groove section means further comprising board attachment means, said board attachment means comprising means to removably attach said groove section means to said playing surface.

12. Board game and playing piece means in accordance with claim 11, wherein:

said board attachment means comprises magnetic means, and said playing surface comprises magnetic attraction means.

13. Board and playing piece means in accordance with claim 11, wherein:

said magnetic means extends beyond the surface of said groove section means which is closest to said playing surface when said groove section means is attached to said playing surface.

14. Board game and playing piece means in accordance with claim 11, wherein:

said vertical-mount means comprises frame means, said frame means being fastenable to a wall, said frame means having attachment means to removably attach said game board means to said frame means.

15. Board and playing piece means in accordance with claim 14, wherein:

said attachment means comprises groove means, said game board means having tongue means cooperating with said groove means whereby said chessboard means is slidably attachable to and removable from said frame means.

16. Board game and playing piece means in accordance with claim 15, wherein:

at least a portion of the front face of said frame means comprises additional groove means, said additional groove means being adapted to receive said tongue of said chess piece tongue section means.

17. Board game and playing piece means in accordance with claim 15, wherein:

at least a portion of the front face of said frame means is magnetically sensitive, said portion being adapted to receive said chess piece groove section means.

18. Board game and playing piece means in accordance with claim 15, wherein:

said attachment means comprises groove means, said game board means having tongue means cooperating with said groove means whereby said chessboard means is snappably attachable to and removable from said frame means.

* * * * *